US010085529B2

(12) United States Patent
Sentoku

(10) Patent No.: US 10,085,529 B2
(45) Date of Patent: Oct. 2, 2018

(54) NON-PIERCED EARRING, AND FITTING IMPLEMENT FOR THE SAME

(71) Applicant: Kiyomizu Glass Inc., Kyoto-shi, Kyoto (JP)

(72) Inventor: Hiroshi Sentoku, Kyoto (JP)

(73) Assignee: JEWELRY KYOTO CO., LTD., Kyoto (JP)

( * ) Notice: Subject to any disclaimer, the term of this patent is extended or adjusted under 35 U.S.C. 154(b) by 187 days.

(21) Appl. No.: 14/908,752

(22) PCT Filed: Jul. 8, 2014

(86) PCT No.: PCT/JP2014/068142
§ 371 (c)(1),
(2) Date: Jan. 29, 2016

(87) PCT Pub. No.: WO2015/016012
PCT Pub. Date: Feb. 5, 2015

(65) Prior Publication Data

US 2016/0166019 A1 Jun. 16, 2016

(30) Foreign Application Priority Data

Aug. 1, 2013 (JP) ..... 2013-160081
May 22, 2014 (JP) ..... 2014-105967

(51) Int. Cl.
*A44C 7/00* (2006.01)
*B25B 7/08* (2006.01)

(52) U.S. Cl.
CPC ..... *A44C 7/006* (2013.01); *A44C 7/005* (2013.01); *B25B 7/08* (2013.01)

(58) Field of Classification Search
CPC ..... A44C 7/00; A44C 7/004; A44C 7/005
(Continued)

(56) References Cited

U.S. PATENT DOCUMENTS 188,323 A * 3/1877 Weed ..... A44C 7/00 24/327
1,791,567 A * 2/1931 Meyer ..... A44C 7/005 63/14.8

(Continued)

FOREIGN PATENT DOCUMENTS

JP 34-4410 U 3/1959
JP 50-89415 U 7/1975

(Continued)

OTHER PUBLICATIONS

"Stylishly with Non-Pierced Earring Like Pierced Earring", URL:http://nanapi.jp/100438/, Jul. 8, 2013, Japan, w/English partial translation, (5 pages).

(Continued)

*Primary Examiner* — Jack W Lavinder
(74) *Attorney, Agent, or Firm* — Westerman, Hattori, Daniels & Adrian, LLP

(57) ABSTRACT

A non-pierced earring can be secured to the earlobe with elastic restoring force of itself, and causes no pain. An implement 6 for fitting, on an earlobe, a non-pierced earring that includes a coupling unit made of an elastic wire material and bent so as to maintain a predetermined distance between both ends, and a pair of ear contact units wider than the diameter of the coupling unit and respectively disposed at both ends of the coupling unit with principal surfaces facing each other includes a pair of levers 7 and 8 each having a front end portion and a rear end portion and coupled to each other between the front end portions and the rear end portions via a rotation shaft so as to cause the front end portions to open or close when the rear end portions close or open.

12 Claims, 13 Drawing Sheets

(58) Field of Classification Search
USPC ..... 63/33, 14.1, 14.3, 4.7, 14.8; 7/125; 81/3.7, 7, 9.3, 302
See application file for complete search history.

(56) References Cited

U.S. PATENT DOCUMENTS

| | | | | | |
|---|---|---|---|---|---|
| 1,978,652 | A | * | 10/1934 | Shea | A44C 7/005 63/14.8 |
| 2,510,511 | A | * | 6/1950 | Mittendorf | A44C 7/005 63/14.3 |
| 2,819,595 | A | | 1/1958 | Northup | |
| 3,540,106 | A | * | 11/1970 | Goldman | B25B 7/02 29/268 |
| 3,739,599 | A | * | 6/1973 | Melone | A44C 7/005 63/13 |

FOREIGN PATENT DOCUMENTS

| | | | |
|---|---|---|---|
| JP | 54-19016 | U | 2/1979 |
| JP | 57-103873 | U | 6/1982 |
| JP | 62-111874 | U | 7/1987 |
| JP | 63-131627 | U | 8/1988 |
| JP | 63-152412 | U | 10/1988 |
| JP | 6-81317 | U | 11/1994 |
| JP | 3084877 | U | 3/2002 |
| JP | 3113063 | U | 9/2005 |
| JP | 3126598 | U | 11/2006 |
| JP | 2011-78460 | A | 4/2011 |

OTHER PUBLICATIONS

International Search Report dated Oct. 21, 2014, issued in counterpart Application No. PCT/JP2014/068142 (2 pages).

* cited by examiner

NON-PIERCED EARRING, AND FITTING IMPLEMENT FOR THE SAME

TECHNICAL FIELD

The present invention relates to a non-pierced earring that looks like a pierced earring and to a fitting implement for the non-pierced earring.

BACKGROUND ART

There are pierced earrings and non-pierced earrings as ornaments to be attached to the ears. Since pierced earrings require wearers to have their earlobes pierced, those who are afraid of the piercing dislike the pierced earrings. Non-pierced earrings have large fasteners and are less fashionable than pierced earrings.

Thus, non-pierced earrings that have small fasteners and look like pierced earrings are preferred. Examples of non-pierced earrings proposed include non-pierced earrings in which a small loop is formed by looping an elastic wire material at the recessed portion of the elastic wire material that is U-shaped and has ornament bodies attached at both ends (Patent Literature 1), non-pierced earrings formed into U shapes using pure titanium to prevent corrosion (Patent Literature 2), and non-pierced earrings in which one end of one of a pair of semicircular ring fragments is hinged on one end of the other fragment via a washer, and the hinged portion is riveted, so that pinching force is generated between the other ends of the ring fragments (Patent Literature 3). In addition, non-pierced earrings are sold that include pipes bent into circles with coil springs incorporated inside the pipes, and pins attached to tips of the coil springs and each protruding from one end of each of the pipes, in which tips of the pins and the other ends of the pipes pinch the earlobes using restoring force of the coil springs (Non Patent Literature 1).

CITATION LIST

Patent Literature

PTL 1: Japanese Unexamined Utility Model Application Publication No. H6-81317

PTL 2: Japanese Utility Model Registration No. 3126598

PTL 3: Japanese Unexamined Patent Application Publication No. 2011-78460

Non Patent Literature

NPL 1: [online], nanapi, [searched on Jul. 8, 2013], the Internet <URL:http://nanapi.jp/100438/>

SUMMARY OF INVENTION

Technical Problem

In the non-pierced earrings disclosed in Patent Literature 1 or 2, unfortunately, the wire materials may deform plastically due to incautious over-widening when wearers try to widen the spaces between both ends with only the fingers to attach the non-pierced earrings to the earlobes. The non-pierced earrings disclosed in Patent Literature 3 are poor in decorativeness because the hinged portions are conspicuous. The non-pierced earrings disclosed in Non Patent Literature 1 apply excessive pressure on the earlobes and cause pain when worn for a long time.

An object of the present invention is, therefore, to provide an implement for fitting a non-pierced earring that looks like a pierced earring, can be secured to the earlobe with elastic restoring force of itself, and causes no pain.

Solution to Problem

To achieve the above object, a non-pierced earring of the present invention includes a coupling unit and a pair of ear contact units. The coupling unit is made of an elastic wire material. The coupling unit is bent so as to maintain a predetermined distance between both ends. The ear contact units are made of a material that is the same as or different from the wire material. The ear contact units are wider than the coupling unit. The ear contact units are respectively disposed at both ends of the coupling unit with the principal surfaces facing each other.

The elastic wire material may be high-strength piano wire or a superelastic wire material.

Superelasticity is a property of regaining the original shape when deforming force is removed even after being deformed by a large distortion of more than 0.5%. In the case of metal wire materials, superelastic materials generally have properties of Young's moduli of 40 to 90 GPa and elastic deformabilities of 2.0% to 7%. The predetermined distance varies depending on the thickness of the earlobe of a person who wears the non-pierced earring and is generally 40% to 80% of the maximum thickness of the earlobe.

The non-pierced earring of the present invention looks like a pierced earring because the ear contact units pinch and hold the earlobe with elastic force of the coupling unit while being worn. In addition, since both ends of the coupling unit maintain the distance, a distance is maintained also between both ear contact units, and no excessive pressure is applied on the earlobe. Furthermore, since the ear contact units are wider than the coupling unit, pressure on the earlobe due to the coupling unit is distributed. Thus, no pain is experienced even after being worn for a long time. The material for the ear contact units may be the same as or different from the material for the coupling unit. When the materials are different, the ear contact units may be secured to the coupling unit by bonding with an adhesive or welding. When the materials are the same, the ear contact units are formed integrally with the coupling unit.

In the non-pierced caning of the present invention, an ornament or ornaments may be attached to one or two of the pair of ear contact units or may be attached to the coupling unit.

When the coupling unit is made of a material having superelasticity, pinching force is less likely to decrease. It is good that the material having superelasticity is made of a Ti—Ni shape-memory alloy in that the space between both ends of the coupling unit can be freely adjusted at temperatures lower than the martensitic transformation start temperature (the Ms temperature).

It is good that the material having superelasticity is made of a β-titanium alloy called GUNMETAL (registered trademark), which has a body-centered cubic structure, in that the pinching force for the earlobe does not decrease even when worn in a cold climate area.

The coupling unit may preferably be U-shaped. This is because the shape allows the non-pierced earring to most surely look like a pierced earring and is easy to work.

At least one of the pair of ear contact units may preferably include a buffer made of a rubber such as a silicone rubber and a urethane rubber on at least one of the inner faces facing each other. This is because the buffer softly touches the earlobe when fitting the non-pierced earring, and absorbs accidental impact on the non-pierced earring during the fitting to some extent to prevent injury.

The non-pierced earring of the present invention may be worn by widening the space between the ear contact units with the fingers and inserting the earlobe between the ear contact units, but a fitting implement may be used to widen the space between the ear contact units when the coupling unit may deform plastically or when the fingers are weak compared to the restoring force.

An appropriate fitting implement includes a pair of levers. These levers each include a front end portion and a rear end portion and are coupled to each other between the front end portions and the rear end portions via a rotation shaft so as to cause the front end portions to open (close) when the rear end portions close (open). In other words, the front end portions and the rear end portions open and close in the directions opposite to each other.

With such a fitting implement, the space between the ear contact units can be easily widened even with weak fingers using the operation caused by inserting the front end portions between the inner faces of the pair of ear contact units or between areas adjacent to the pair of ear contact units with the front end portions being in a closed or half-open state, and closing the rear end portions. Over-widening of the space between the ear contact units beyond the elastic region of the coupling unit can also be prevented. While the rear end portions are closed, the outer faces of the front end portions are pressed against the inner faces of the ear contact units or against areas adjacent to both ends of the coupling unit, resisting the elastic restoring farce of the coupling unit, and the non-pierced earring is held by the front end portions. Thus, the non-pierced earring is secured to the earlobe by inserting the earlobe between the front end portions while holding the closed rear end portions and then decreasing the grip force on the rear end portions to pull the fitting implement out.

At least one of the levers may preferably include a bearing protruding inward between the front end portion and the rear end portion. With this constitution, a motion can be easily realized that the front end portions and the rear end portions open and close in the directions opposite to each other.

In a more preferable constitution, the front end portion of at least one lever of the levers may have a shallowly depressed outer face approaching the front end portion of another lever toward the bottom. This constitution causes the non-pierced earring to be less likely to drop off the fitting implement because, when a ball is attached or the buffer is disposed on the ear contact units, the ball or the buffer fits in the shallow depression.

The front end portion of at least one lever of the levers may preferably have a flat outer face parallel to the rotation shaft. This is because this constitution makes it easy to pull the fitting implement out between the non-pierced earring and the earlobe.

The front end portions of the levers may be inserted just below the ear contact units and pressed against the elastic wire material. This method makes it easier to pull the fitting implement out between the non-pierced earring and the earlobe. When this method is used, the front end portion of at least one lever of the levers may preferably have a flat outer face making an acute angle with the rotation shaft. This constitution causes the entire outer face of the front end portion of the lever to be pressed against the elastic wire material when the space between the ear contact units is widened, and thus the constitution makes it easy to widen the space between the ear contact units and also to pull the fitting implement out.

In a particularly preferable constitution, the front end portions of both levers may have at least one of the flat outer faces and/or the shallowly depressed outer faces.

A rotation angle of the levers may preferably be restricted by collision of the rear end portion of a first lever with the rear end portion of a second lever. This constitution can set the maximum distance between the outer faces of the front end portions to be constant.

The front end portion of at least one lever of the levers may preferably be thinner than the rear end portion of the same lever when viewed in the shaft direction. This constitution makes it easy to insert the front end portions into the space between the ear contact units even when the space is narrow. In a particularly preferable constitution, the front end portions of both levers may be thinner than the rear end portions.

The rear end portion of at least one lever of the levers may preferably be wider than the front end portion of the same lever in the shaft direction. This is because this constitution makes it easy to hold the rear end portions. In a particularly preferable constitution, the rear end portions of both levers may be wider.

The maximum distance between the outer faces of the front end portions when the front end portions are open may commonly be equal to or less than 10 mm, preferably equal to or less than 8 mm, and particularly preferably equal to or less than 6 mm. Depending on the overall length, the modulus of elasticity, and the outer diameter of the elastic wire material constituting the coupling unit, setting the maximum distance between the outer faces of the front end portions to equal to or less than 6 mm causes the space between the ear contact units to be always widened within the elastic region of the coupling unit and can reliably prevent the coupling unit from deforming plastically.

The fitting implement may preferably have a spring to perform biasing toward a direction that the rear end portions of the pair of levers open. The front end portions are closed by the force of this spring without external force, and thus it is easy to insert the front end portions between the ear contact units.

Advantageous Effects of Invention

As described above, the non-pierced caning of the present invention looks like a pierced caning and causes no pain without decreases in pinching force, and thus a wearer can lightly attach a similar ornament as an ornament of a pierced earring on the ear. In addition, the fitting implement of the present invention makes it easy to attach the non-pierced earring to the earlobe regardless of strength of the fingers without plastic deformation of the non-pierced earring.

BRIEF DESCRIPTION OF DRAWINGS

FIG. 3(*b*) is a plan view of the same, and FIG. 3(*c*) is a bottom view of a second lever.

DESCRIPTION OF EMBODIMENTS

Embodiment 1

Figure 1A:
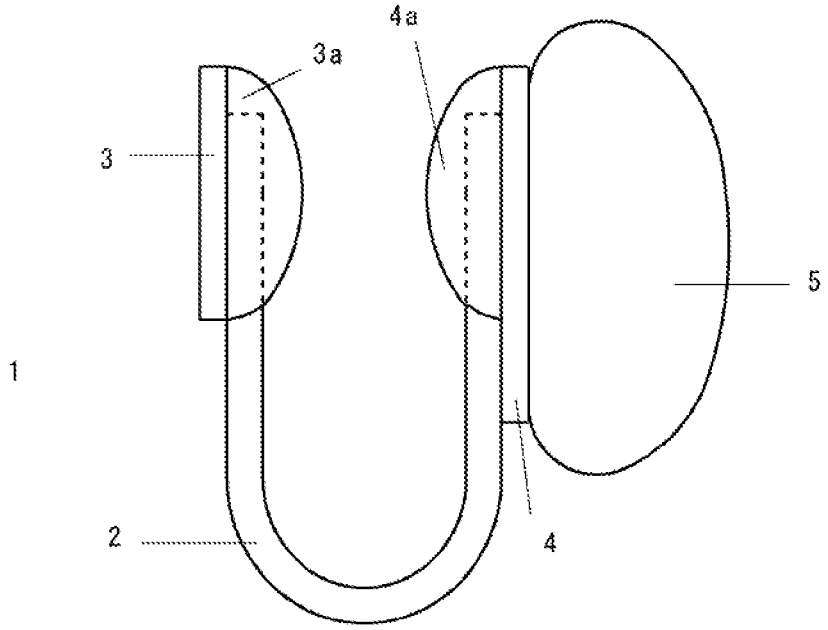
FIG. 1(*a*) is a front view of a non-pierced earring of Embodiment 1, and FIG. 1(*b*) is a side view of the same.
Figure 1B:
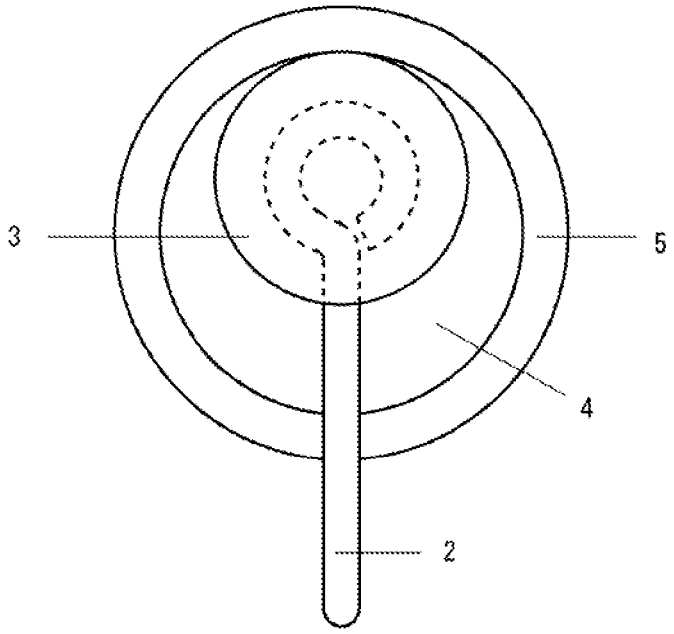

A non-pierced earring 1 of this embodiment includes a coupling unit 2 that is U-shaped in a front view as illustrated in FIG. 1, disk-shaped ear contact units 3 and 4 respectively secured to both ends of the coupling unit, and an ornament 5.

The coupling unit 2 is formed by bending a wire material made of a Ti—Ni shape-memory alloy having a diameter of 0.7 mm into a U shape at equal to or lower than the transformation point so that the space between both ends will be about as large as the thickness of the earlobe, for example, 4 mm to 5 mm, and further bending the material so that the portions adjacent to both ends will be rings in planes orthogonal to the U shape and parallel to the center line of the U shape. The distance from both ends to the bottom of the U shape may be a distance with which the bottom of the U shape does not push the earlobe up and both ends of the U shape touch a thin portion of the earlobe, for example, about 10 mm.

The ear contact units 3 and 4 are both made of metal such as brass, iron, and stainless steel having a thickness of 0.5 mm and are respectively bonded with an adhesive or welded to the outer faces of the rings at both ends of the coupling unit 2. On the inner faces of the ear contact units 3 and 4, a silicone rubber is applied to the extent that the ring portions at both ends of the coupling unit 2 are buried to constitute buffers 3*a* and 4*a*. The diameter of the ear contact unit 3 is 5 mm, and the diameter of the ear contact unit 4 is 7 mm. The ornament 5 is attached to the outer face of the ear contact unit 4. The space between the buffers 3*a* and 4*a* is commonly 0.7 to 1.3 mm, depending on the thickness of the earlobe of a person who wears the non-pierced caning 1.

When the non-pierced earring 1 is to be worn, the non-pierced earring 1 is cooled by being held in a refrigerator, and the space between the ear contact units 3 and 4 is adjusted appropriately while the non-pierced earring 1 is still cool after being taken out of the refrigerator. This operation is not required afterward if the space has reached the extent that the wearer is satisfied, as long as the wearer is the same. Next, the space between the ear contact units 3 and 4 of the non-pierced caning 1 that has reached an ordinary temperature is widened with the fingers, the earlobe is inserted between the ear contact units 3 and 4, the earlobe is pinched by the ear contact units 3 and 4 by relaxing the fingers, and the non-pierced earring 1 is secured to the ear. The buffers 3*a* and 4*a* softly touch the earlobe, and thus the non-pierced earring 1 does not injure the earlobe when inserting the earlobe. In addition, the buffers 3*a* and 4*a* absorb part of accidental impact on the non-pierced earring 1 during the fitting, and injury rarely occur.

The non-pierced caning 1 looks like a pierced earring because the ear contact units 3 and 4 pinch and hold the earlobe with elastic force of the coupling unit 2 while being worn. The pinching force does not decrease because the coupling unit 2 is made of a shape-memory alloy. In addition, since both ends of the coupling unit 2 maintain a distance about as large as the thickness of the earlobe, about the same distance is maintained also between the ear contact units 3 and 4, and no excessive pressure is applied on the earlobe. Furthermore, since the ear contact units 3 and 4 are made of plates having larger widths than the diameter of the wire material, pressure on the earlobe due to the wire material is distributed. Thus, no pain is experienced even after being worn for a long time.

Figure 2A:
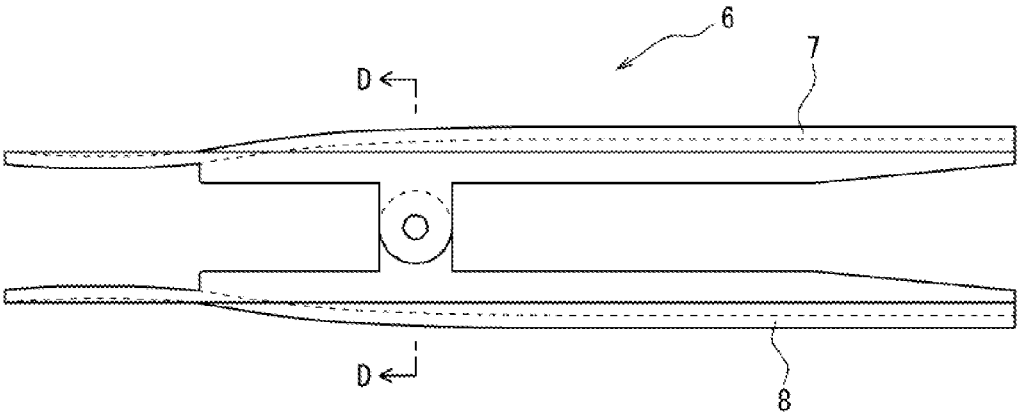
FIG. 2(*a*) is a front view of a fitting implement of Embodiment 1, FIG. 2(*b*) is a plan view of the same, and FIG. 2(*c*) is a cross-sectional view along the line D-D in FIG. 2(*a*).
Figure 2B:
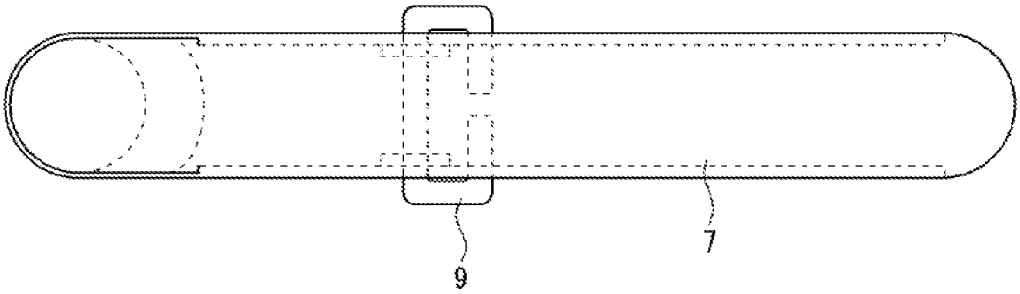
Figure 2C:
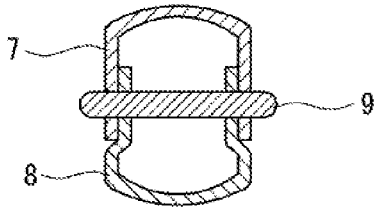
Figure 3A:
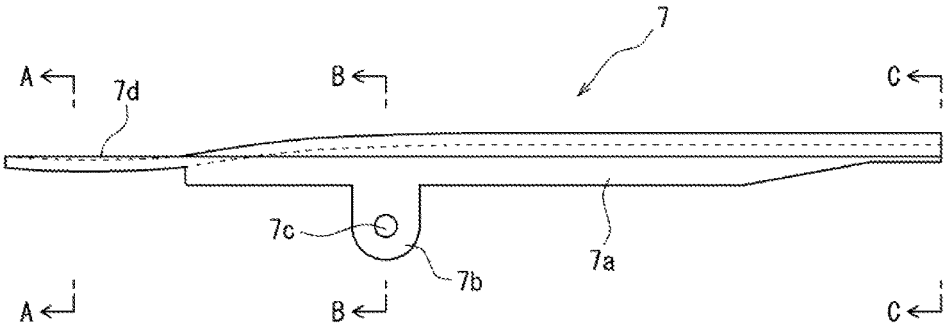
FIG. 3(*a*) is a front view of a first lever of the fitting implement.
Figure 3B:
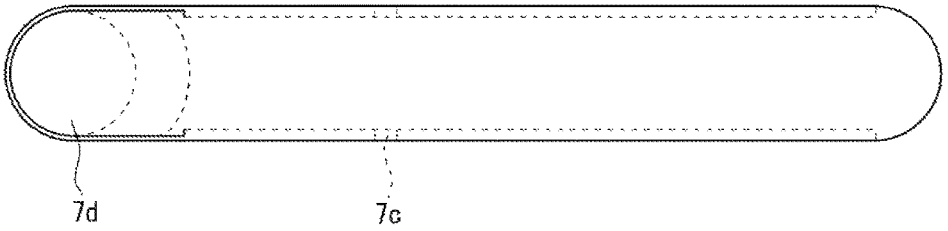
Figure 3C:
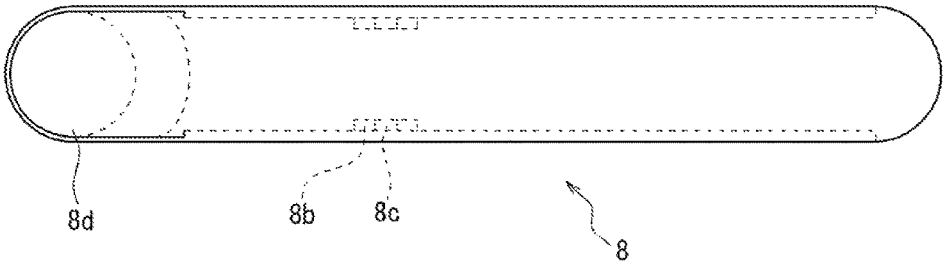
Figure 4A:
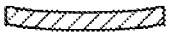
FIG. 4(*a*) is a cross-sectional view along the line A-A in FIG. 3(*a*), FIG. 4(*b*) is a cross-sectional view along the B-B in the same, and FIG. 4(*c*) is a cross-sectional view along the line C-C in the same.
Figure 4B:
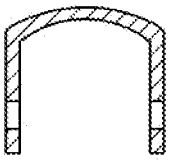
Figure 4C:
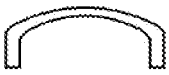

It is good to use a fitting implement 6 illustrated in FIG. 2 to FIG. 4 to wear the non-pierced earring 1 when it is difficult to widen the space between the ear contact units 3 and 4 with only the fingers and when the coupling unit 2 may deform plastically due to over-widening.

The fitting implement 6 includes a pair of levers 7 and 8 coupled to each other at the middle portion in the length direction so that front end portions and rear end portions will open and close in the directions opposite to each other, and a cylindrical rotation shaft 9 that rotatably couples the levers 7 and 8.

The lever 7 is made of a stainless steel plate or an anticorrosion-treated metal plate. As illustrated in FIGS. 3(*a*) and 3(*b*), the lever 7 has such an outer shape as the shape of a track for track and field events, which is defined by two parallel long sides and semicircular short sides coupling the long sides in a plan view, and includes tabs 7*a* for reinforcement extending from both long sides in the direction perpendicular to the plane. The tabs 7*a* for reinforcement have uniform widths except that bearings 7*b* further extending in the perpendicular direction are formed at points somewhat apart from the middle point toward the front end in the length direction, that the tabs 7*a* for reinforcement end before reaching the front end of the lever 7, and that the widths gradually decrease toward the rear end in the portion adjacent to the rear end of the lever 7. The bearings 7*b* have holes 7*c* through which the rotation shaft 9 is passed. The upper face adjacent to the front end of the lever 7 has a shallow circular depression 7*d* having a depth of about 0.2 mm in a plan view. The area of the depression 7*d* is about as large as the application area of the buffer 3*a* or 4*a*.

Figure 5A:
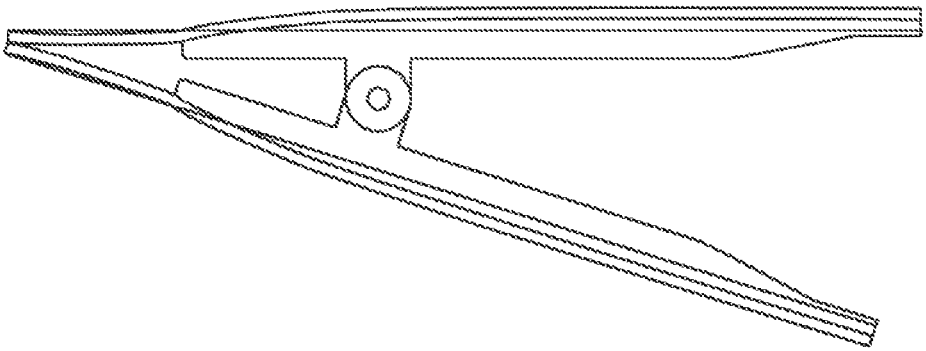
FIG. 5(*a*), FIG. 5(*b*), and FIG. 5(*c*) are front views respectively illustrating a closed state, a half-open state, and an open state of front end portions among motions of the fitting implement.
Figure 5B:
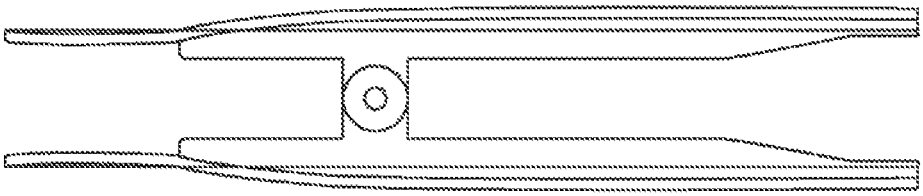
Figure 5C:
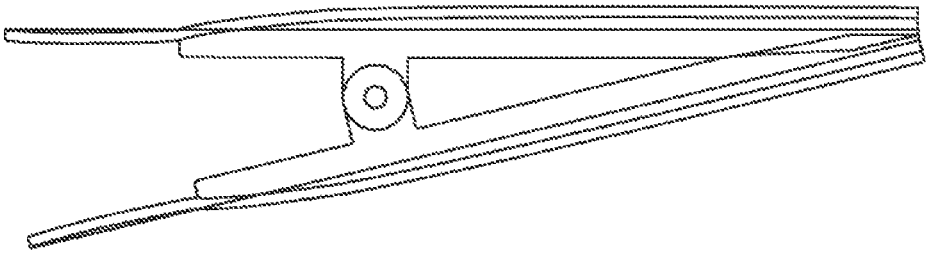

The lever 8 has the same shape as the shape of the lever 7 except that the space between the bearings 8*b* and 8*b* is smaller by the plate thickness of the lever 7. The fitting implement 6 is completed by passing the rotation shaft 9 through the holes with the bearings 7*b* and 7*b* being aligned with the bearings 8*b* and 8*b*, and then bending both ends of the rotation shaft 9. In the fitting implement 6, as illustrated in FIG. 5, the levers 7 and 8 move so that the front end portions will close when the rear end portions open, and the front end portions will open when the rear end portions close. The rotation angle is restricted by collision of the front end portions with each other or the rear end portions with each other in either rotation direction. The rotation shaft 9 may be prevented from dropping off the bearings by riveting instead of bending both ends.

Figure 6:
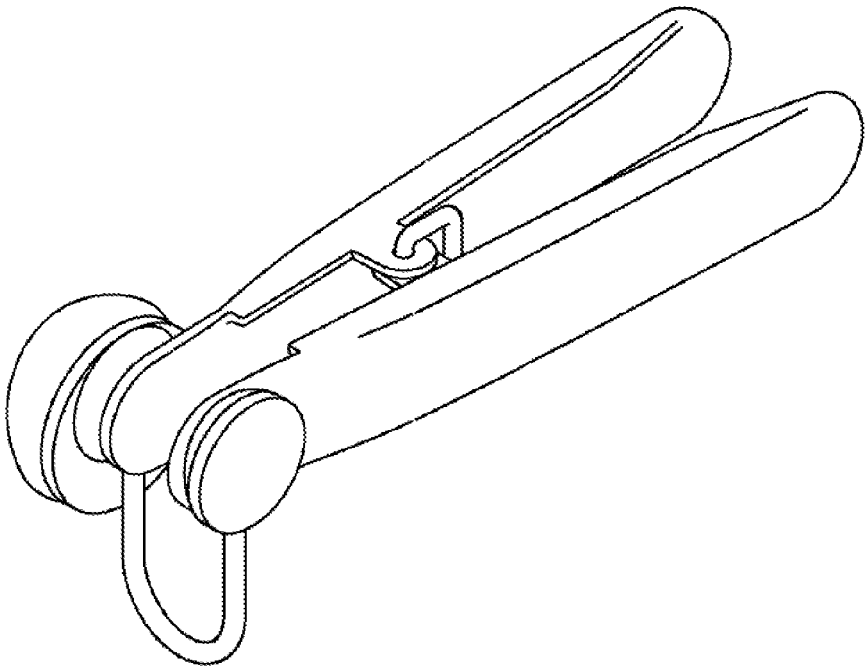
FIG. 6 is as perspective view illustrating a method for widening the space between ear contact units of the non-pierced earring using the fitting implement.

When the fitting implement 6 is used, the front end portions are inserted between the inner faces of the ear contact units 3 and 4 with the front end portions being in a half-open state as illustrated in FIG. 6, and then the rear end portions are closed. This operation fully opens the front end portions and causes the buffers 3*a* and 4*a* to fit in the depressions 7*d* and 8*d* to prevent the non-pierced earring 1 from dropping off the fitting implement 6, and the space between the ear contact units 3 and 4 can be easily widened by the action of levers. In addition, the risk that the space may be unable to return to the original size due to over-opening of the ear contact units 3 and 4 can be prevented because the state in which the rear end portions contact each other is the maximum of the degree of opening of the front end portions.

Figure 7:
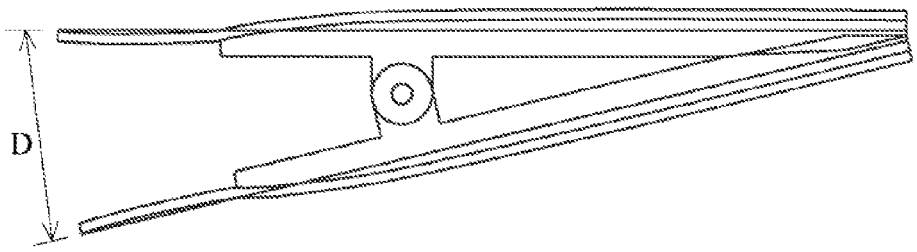
FIG. 7 is a diagram illustrating the maximum distance between outer faces of the front end portions when the front end portions of the fitting implement are open.
Figure 8:
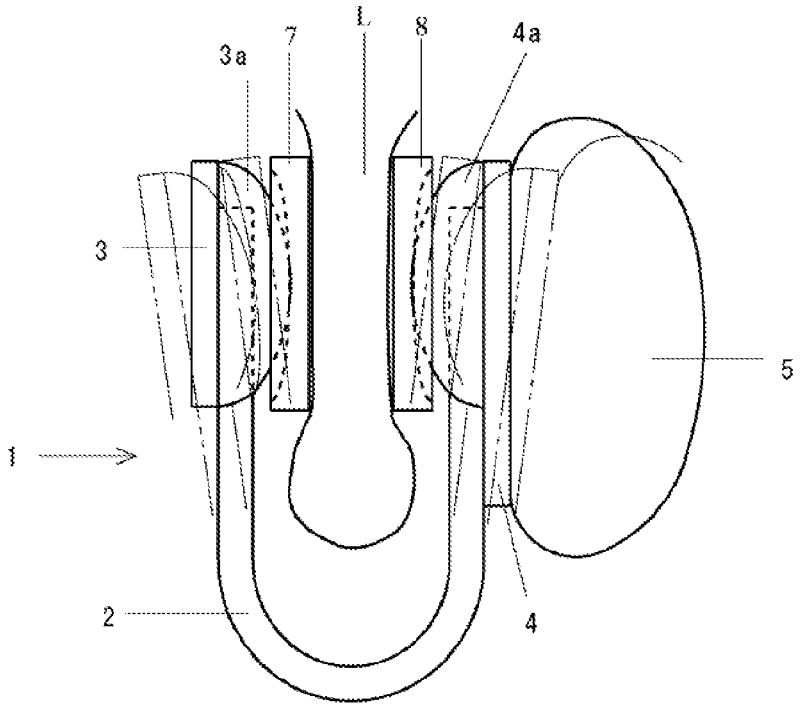
FIG. 8 is a view of the non-pierced earring being attached to the earlobe with the fitting implement taken from the front of the non-pierced earring.

In other words, as long as the non-pierced earring 1 is attached using the fitting implement 6, the space between the ear contact units 3 and 4 does not become wider than a distance D between the front end portions of when the rear end portions are closed as illustrated in FIG. 7, and plastic deformation of the coupling unit 2 is prevented. The distance D is, for example, 5.5 mm. An earlobe L is inserted between the front end portions with the front end portions being opened as illustrated by the imaginary lines in FIG. 8, and the front end portions are closed as illustrated by the solid lines. After that, the fitting implement 6 is slowly pulled out while the non-pierced earring 1 is pinched by the hand from both sides of the earlobe L, and thus the non-pierced earring 1 is secured to the earlobe L.

When the non-pierced earring 1 does not include the buffers 3*a* and 4*a*, the depressions 7*d* and 8*d* may not be disposed.

Embodiment 2

Figure 9:
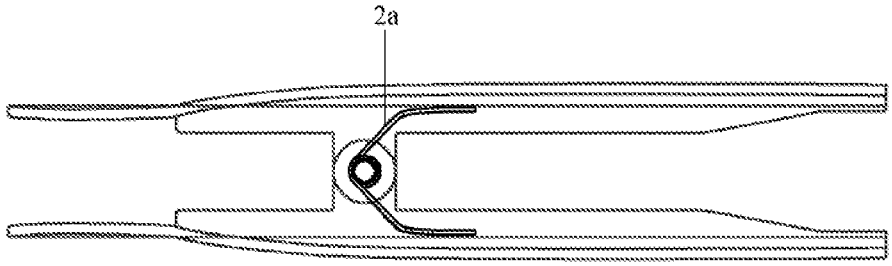
FIG. 9 is a front view of a fitting implement of Embodiment 2.

The fitting implement 6 may include a spring that biases the rear end portions of the levers 7 and 8 toward the opening direction. Examples of the spring include such a torsion spring 2*a* as illustrated in FIG. 9. With this constitution, a closed state of the front end portions of the levers 7 and 8 can be easily maintained, and the front end portions can be easily inserted between the ear contact units of the non-pierced earring.

Embodiment 3

Figure 10:
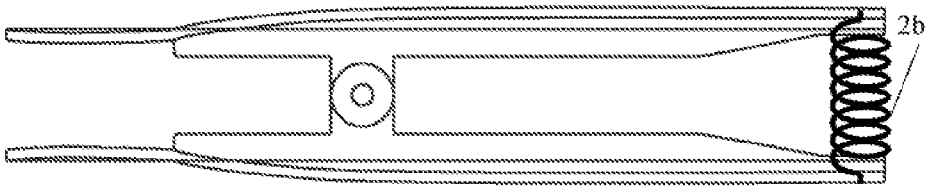
FIG. 10 is a front view of a fitting implement of Embodiment 3.

A coil spring 2*b* may be attached so as to straddle the rear end portions of the levers 7 and 8 as illustrated in FIG. 10, in place of the torsion spring 2*a* in Embodiment 2.

Embodiment 4

Figure 11:
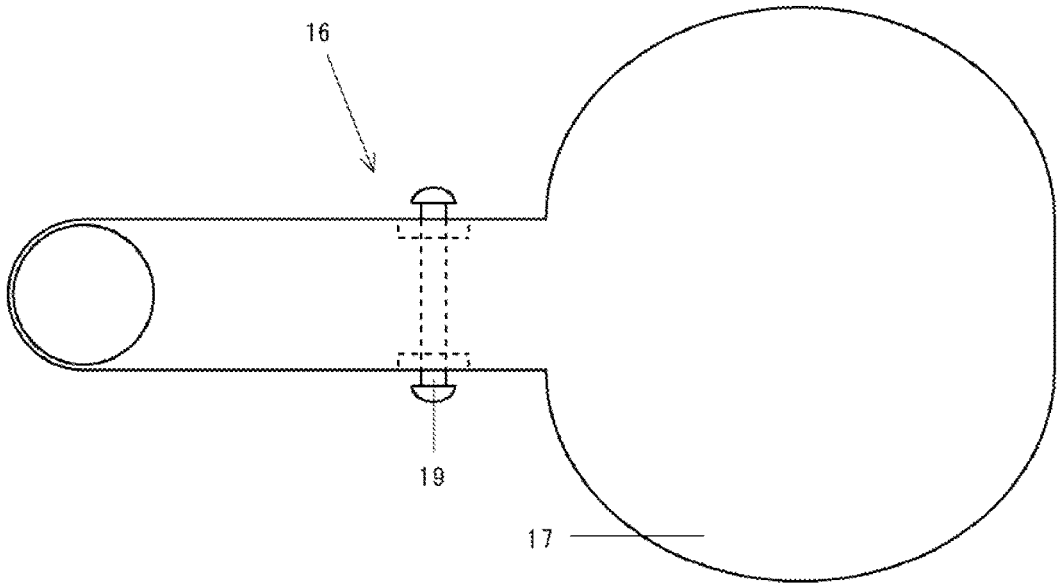
FIG. 11 is a plan view of a fitting implement of Embodiment 4.

In a fitting implement 16 of this embodiment, the rear end portion of a lever 17 is wider in the rotation shaft 19 direction than the front end portion of the same lever as illustrated in FIG. 11, and the widened areas have semicircular shapes. The tabs for reinforcement are not disposed because the entire lever 17 is formed of a metal plate or a plastic thicker than the lever 7 of Embodiment 1. The other lever 18 that is not illustrated has a similar shape. This constitution makes it easy to hold the rear end portions. Both ends of a rotation shaft 19 are riveted.

Embodiment 5

Figure 12A:
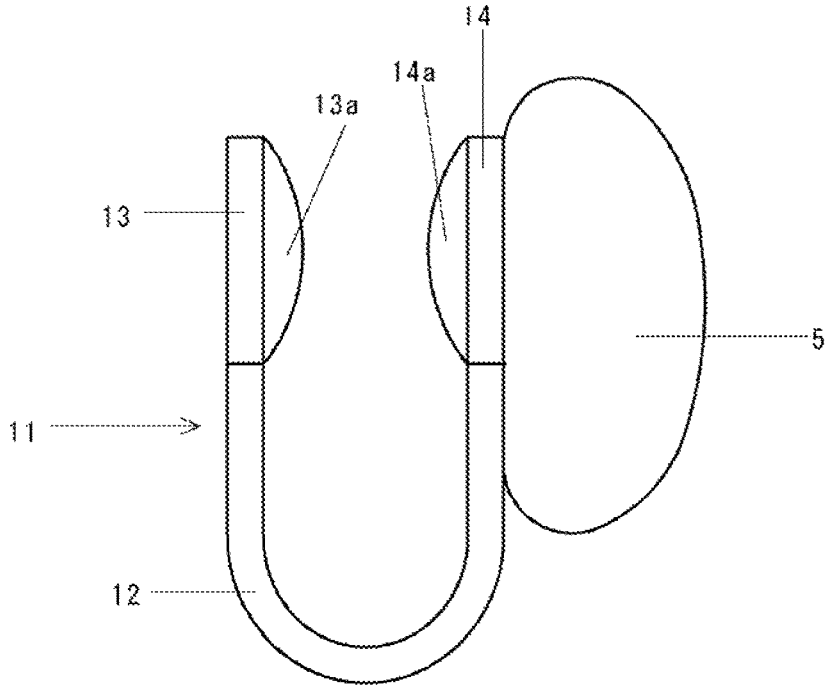
FIG. 12(*a*) is a front view of a non-pierced earring of Embodiment 5, and FIG. 12(*b*) is a side view of the same.
Figure 12B:
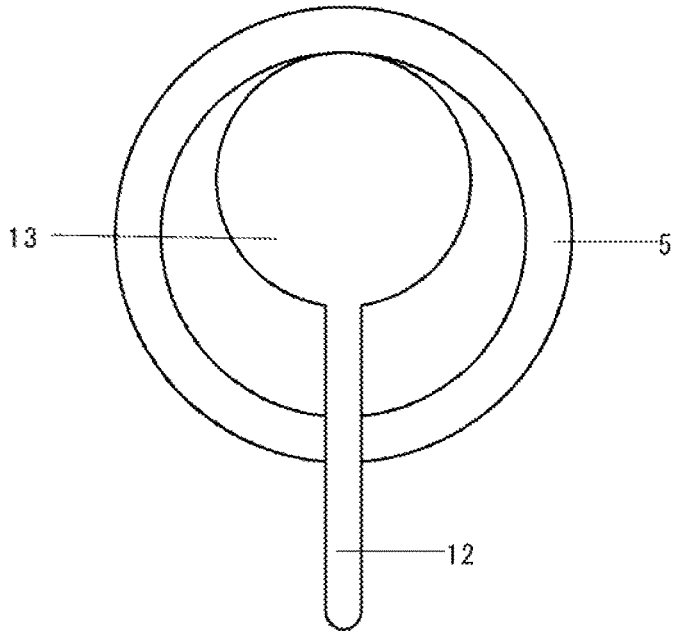
Figure 13B:
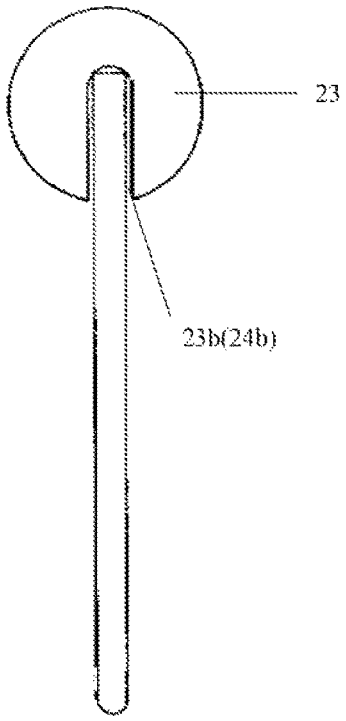
FIG. 13(*a*) is a front view of an intermediate product of a non-pierced earring of Embodiment 6, and FIG. 13(*b*) is a side view of the same.
Figure 13A:
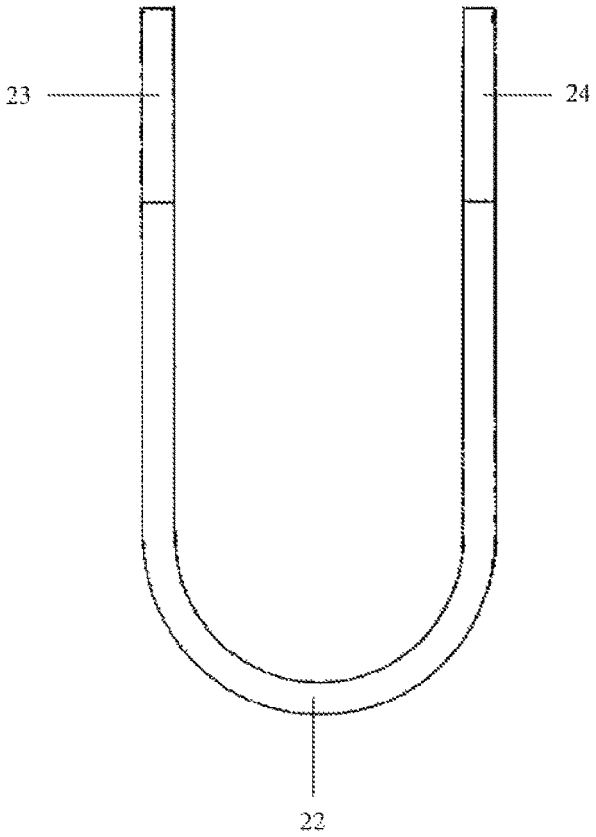
Figure 14C:
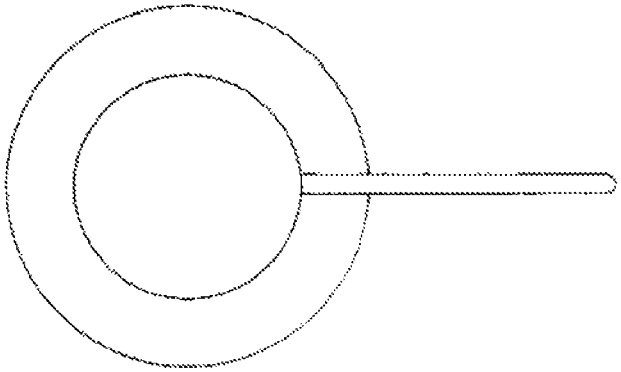
FIG. 14(*a*) is as front view of the non-pierced earring of Embodiment 6, 14(*b*) is a left-side view of the same, and FIG. 14(*c*) is a right-side view of the same.
Figure 14A:
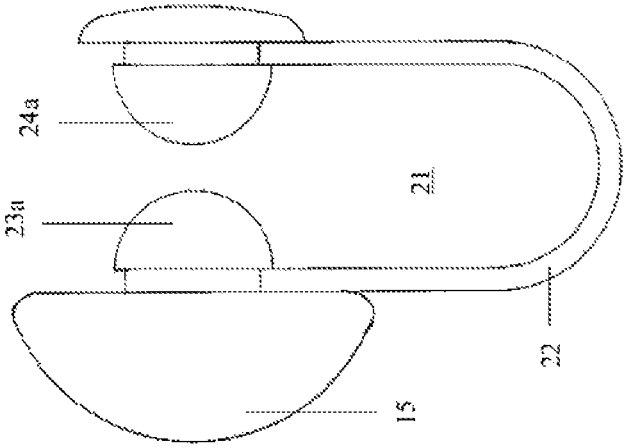
Figure 14B:
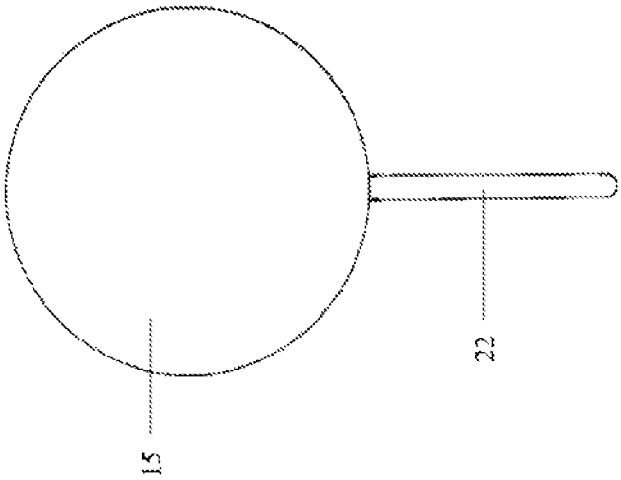

A non-pierced earring 11 of this embodiment shares, with the non-pierced earring of Embodiment 1, the features that a coupling unit 12 is U-shaped in a front view, that ear contact units 13 and 14 are disposed on both ends of the coupling unit 12 and are disk-shaped, and that the non-pierced earring 11 includes the ornament 5, as illustrated in FIG. 12.

The difference from Embodiment 1 is that the coupling unit 12 and the ear contact units 13 and 14 are made of the same Ti—Ni shape-memory alloy and are integrally worked continuously with each other. Thus, there is no risk of dropping of the ear contact units 13 and 14 off the coupling unit 12 even after use for a long time.

Embodiment 6

A non-pierced earring 21 of this embodiment includes a coupling unit 22 and ear contact units 23 and 24 that are separately worked as in Embodiment 1. The coupling unit 22 is formed by bending a wire material of high-strength piano wire having a diameter of 0.5 mm into a U shape. The ear contact unit 23 is made of an approximately disk-shaped metal plate and has a slit 23*b* about as wide as the diameter of the wire material from the center toward the radial direction. The ear contact unit 24 also has a similar slit 24*b*. An end (the other end) of the coupling unit 22 is fit in the slit 23*b* (24*b*) and, in this state, is welded to the ear contact unit 23 (24).

A urethane rubber is applied to each inner face of the ear contact units 23 and 24 to constitute buffers 23*a* and 24*a*. An ornament 15 is attached to the outer face of the ear contact unit 23. The ornament 15 is also attached to the coupling unit which is different from Embodiment 1.

Embodiment 7

Figure 15:
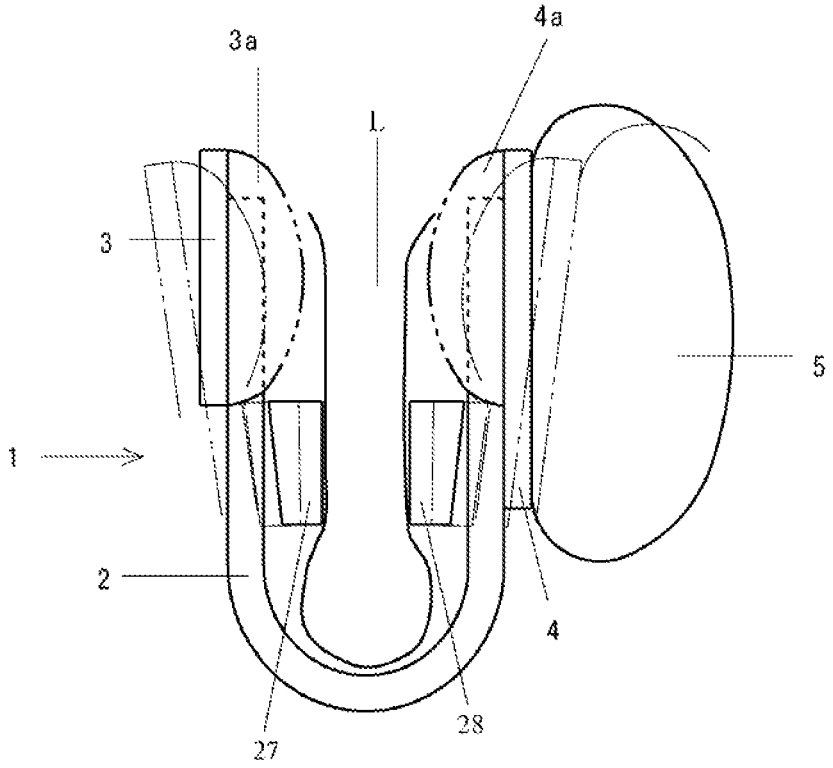
FIG. 15 is a view of the non-pierced earring of Embodiment 1 being attached to the earlobe with a fitting implement of Embodiment 7 taken from the front of the non-pierced earring.
Figure 16A:
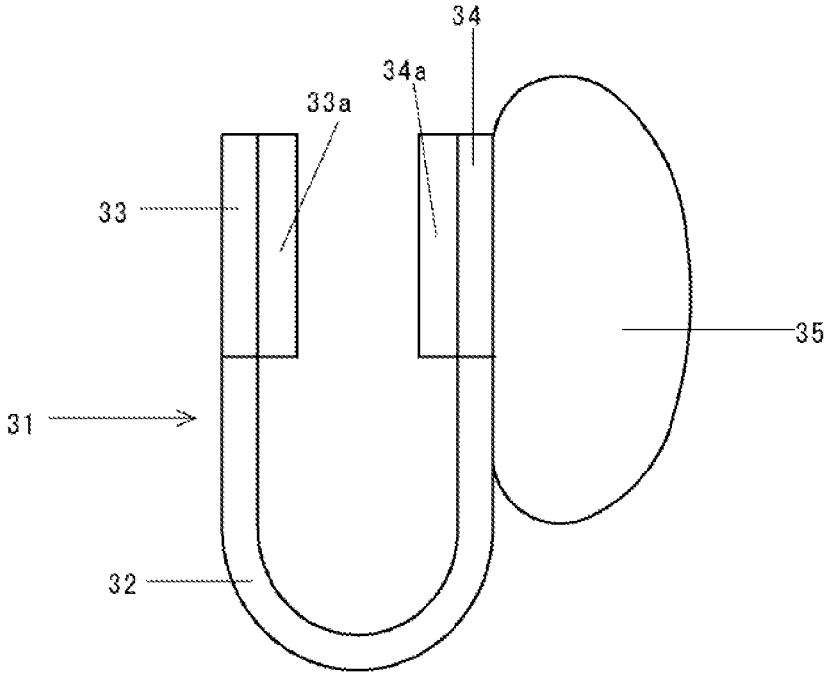
FIG. 16(*a*) is a front view of a non-pierced earring of Embodiment 8, and FIG. 16(*b*) is a side view of the same.
Figure 16B:
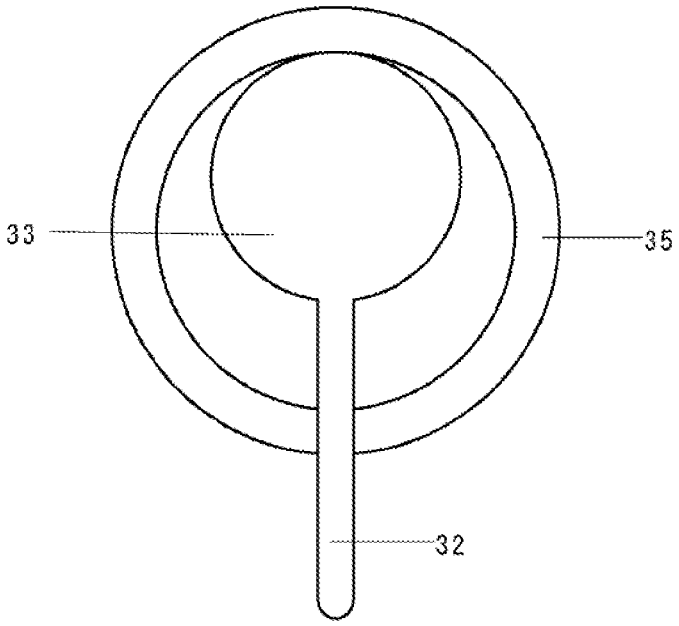

In a fitting implement of this embodiment, the front end portions of levers 27 and 28 have inverted trapezoidal shapes in a cross-sectional view in the thickness direction. In other words, the inner faces of the front end portions facing each other are parallel to the rotation shaft, and the outer faces make acute angles with the rotation shaft. This constitution causes the entire outer faces of the from end portions of the levers 27 and 28 to be pressed against the elastic wire material of the coupling unit 2 as illustrated in FIG. 15 when the space between the ear contact units is widened, and thus the constitution makes it easy to widen the space between the ear contact units 3 and 4 and also to pull the fitting implement out.

Embodiment 8

In a non-pierced earring 31 of this embodiment, buffers 33*a* and 34*a* secured to the inner faces of ear contact units 33 and 34 facing each other are made of cylindrical or drum-shaped urethane rubbers. The buffers 33*a* and 34*a* are disposed by, for example, die-cutting a rubber sheet with a die into a cylindrical shape, leaving the products as they are or chamfering the ridge lines, and then respectively bonding the products to the inner faces of the ear contact units 33 and 34 with an adhesive. Pressure on the earlobe is further distributed because the faces of the buffers 33*a* and 34*a* to contact the earlobe are flat. Other elements may be the same as the elements of Embodiment 5 in both shape and quality.

Embodiment 9

In a fitting implement of this embodiment, to the inner face of the rear end portion of one lever 7 (8) in the fitting implement 6 of Embodiment 1, a spacer protruding toward the rear end portion of the other lever 8 (7) is attached by known means such as welding and screws, which is not illustrated. This constitution prevents the rear end portions of the levers 7 and 8 from being closed excessively narrowly beyond the height of the spacer and further prevents over-opening of the front end portions.

REFERENCE SIGNS LIST 1, 11, 21, 31 Non-pierced earrings
2, 12, 22, 32 Coupling Units
3, 4, 13, 14, 23, 24, 33, 34 Ear Contact Units
5, 15, 35 Ornaments
6 Fitting Implement
7, 8, 17, 27, 28 Levers
9, 19 Pins

The invention claimed is:

1. A non-pierced earring fitting implement for fitting a non-pierced earring on an earlobe, wherein the non-pierced earring to be fitted comprises:
- a coupling unit comprising an elastic wire material and bent so as to maintain a predetermined distance between both ends; and
- a pair of ear contact units respectively disposed at both ends of the coupling unit with principal surfaces facing each other, each ear contact unit being wider than the coupling unit, the non-pierced earring fitting implement comprising:
- a pair of levers each comprising a front end portion and a rear end portion, thereby the levers collectively having front end portions and rear end portions, the pair of levers capable of becoming parallel with each other when the front end portions are in a half-open state; and
- a rotation shaft for coupling the pair of levers together at an intermediate portion between the front end portion and the rear end portion so as to cause the front end portions, to be inserted between the pair of ear contact units, to open or close when the rear end portions close or open,
- wherein the pair of levers have a maximum distance equal to or less than 10 mm between respective outer faces of the front end portions when the front end portions are open.

2. The fitting implement according to claim 1, wherein at least one of the levers comprises a bearing protruding inward between the front end portion and the rear end portion.

3. The fitting implement according to claim 1, wherein the front end portion of at least one lever of the levers has a shallowly depressed outer face approaching the front end portion of another lever toward a bottom of an outer face.

4. The fitting implement according to claim 1, wherein the front end portion of at least one lever of the levers has a flat outer face parallel to the rotation shaft.

5. The fitting implement according to claim 1, wherein the front end portion of at least one lever of the levers has a flat outer face making an acute angle with the rotation shaft.

6. The fitting implement according to claim 1, wherein a rotation angle of the pair of levers is restricted by collision of a rear end portion of a first lever with a rear end portion of a second lever.

7. The fitting implement according to claim 1, wherein the front end portion of at least one lever of the levers is thinner than the rear end portion of the same lever when viewed in a rotation shaft direction.

8. The fitting implement according to claim 1, wherein the rear end portion of at least one lever of the levers is wider than the front end portion of the same lever in a rotation shaft direction.

9. The fitting implement according to claim 1, the fitting implement further comprising a spring to perform biasing toward a direction that the rear end portions of the pair of levers open.

10. A method of fitting a non-pierced earring comprising a coupling unit and a pair of ear contact units to an earlobe, the method comprising:
- providing a fitting implement comprising a pair of levers coupled to each other via a rotation shaft so as to cause front end portions of the pair of levers to open or close when rear end portions of the pair of levers close or open;
- widening a space between the ear contact units by inserting the front end portions of the pair of levers between inner faces of the pair of ear contact units or between areas adjacent to the pair of ear contact units with the front end portions being in a closed or half-open state and closing the rear end portions with a gripping force; and
- decreasing the gripping force to pull the fitting implement out,
- wherein the coupling unit comprises an elastic wire material and bent so as to maintain a predetermined distance between both ends, the ear contact units are respectively disposed at both ends of the coupling unit with principal surfaces facing each other, and each ear contact unit is wider than the coupling unit.

11. The method according to claim 10, wherein the pair of levers have a maximum distance equal to or less than 10 mm between outer faces of the front end portions when the front end portions are open.

12. A system for applying a non-pierced earring to an earlobe, comprising:
- the non-pierced earring and
- a non-pierced earring fitting implement,
- wherein the non-pierced earring comprises:
  - a coupling unit comprising an elastic wire material and bent so as to maintain a predetermined distance between both ends; and
  - a pair of ear contact units respectively disposed at both ends of the coupling unit with principal surfaces facing each other, each ear contact unit being wider than the coupling unit,
- wherein the non-pierced earring fitting implement comprises:
  - a pair of levers each comprising a front end portion and a rear end portion, thereby the levers collectively having front end portions and rear end portions, the pair of levers capable of becoming parallel with each other when the front end portions are in a half-open state; and a rotation shaft for coupling the pair of levers together at an intermediate portion between the front end portion and the rear end portion so as to cause the front end portions, to be inserted between the pair of ear contact units, to open or close when the rear end portions close or open, wherein the pair of levers have a maximum distance equal to or less than 10 mm between respective outer faces of the front end portions when the front end portions are open.

* * * * *